US007635955B2

(12) United States Patent
Yoo et al.

(10) Patent No.: US 7,635,955 B2
(45) **Date of Patent: *Dec. 22, 2009**

(54) BACK LIGHT ASSEMBLY AND DISPLAY APPARATUS HAVING THE SAME

(75) Inventors: Hyeong-Suk Yoo, Yongin-si (KR); Sang-Yu Lee, Yongin-si (KR); Seok-Hyun Nam, Seoul (KR)

(73) Assignee: Samsung Electronics Co., Ltd. (KR)

( * ) Notice: Subject to any disclaimer, the term of this patent is extended or adjusted under 35 U.S.C. 154(b) by 191 days.

This patent is subject to a terminal disclaimer.

(21) Appl. No.: 11/549,989

(22) Filed: Oct. 17, 2006

(65) Prior Publication Data

US 2007/0120500 A1 May 31, 2007

Related U.S. Application Data

(63) Continuation of application No. 10/910,944, filed on Aug. 4, 2004, now Pat. No. 7,126,286.

(30) Foreign Application Priority Data

Aug. 7, 2003 (KR) ..... 10-2003-54768

(51) Int. Cl.
*H05B 37/00* (2006.01)

(52) U.S. Cl. ..... 315/219; 315/224; 315/276; 315/277

(58) Field of Classification Search ..... 315/219, 315/224, DIG. 4, 276, 277
See application file for complete search history.

(56) References Cited

U.S. PATENT DOCUMENTS

| | | | | |
|---|---|---|---|---|
| 5,898,278 | A | 4/1999 | Muessli | |
| 5,965,988 | A * | 10/1999 | Vollkommer et al. | 315/246 |
| 6,914,391 | B2 | 7/2005 | Takeda et al. | |
| 2002/0036608 | A1 | 3/2002 | Hirakata et al. | |

* cited by examiner

*Primary Examiner*—David Hung Vu
(74) *Attorney, Agent, or Firm*—Cantor Colburn LLP

(57) ABSTRACT

A lamp assembly includes a lamp and a lamp driving device. The lamp includes a body and first and second electrodes. The body converts invisible ray generated by a discharge into visible ray, and the electrodes are disposed on the body. The lamp driving device provides the first and second electrodes with first and second driving voltages, respectively, to generate the discharge. The first driving voltage is less than a first critical voltage at which a corona discharge occurs at the first and second electrodes. When the first electrode is electrically connected to a ground, the first critical voltage may be about 1,200 volts. When the second driving voltage has an inverted phase with respect to the first driving voltage, the first critical voltage is about 2,400 volts. An ozone gas may not be generated at the first and second electrodes to prevent the damage of the electrodes.

12 Claims, 6 Drawing Sheets

BACK LIGHT ASSEMBLY AND DISPLAY APPARATUS HAVING THE SAME

CROSS-REFERENCE TO RELATED APPLICATIONS

This application is a continuation application of U.S. application Ser. No. 10/910,944, now U.S. Pat. No. 7,126,286 filed on Aug. 4, 2004, which claims priority to Korean Patent Application No. 2003-54768, filed on Aug. 7, 2003, and all the benefits accruing therefrom under 35 U.S.C. § 119, the contents of which in their entirety are herein incorporated by reference.

BACKGROUND OF THE INVENTION

1. Field of the Invention

The present invention relates to a lamp assembly, a back light assembly having the lamp assembly, and a display device having the back light assembly.

2. Description of the Related Art

Generally, a display device converts an electric signal, which is generated in an information-processing device, into an image.

A liquid crystal display device (LCD), one of the typical display devices, displays the image using liquid crystal (LC). The LCD includes a light generating module and a liquid crystal control module for displaying the image.

The light generating module generates a light so as to display the image, and the liquid crystal control module controls the LC so as to adjust the transmittance of the light.

Additionally, the light generating module may includes a cold cathode fluorescent lamp (CCFL) in order to generate the light. The CCFL is classified into an internal electrode fluorescent lamp (IEFL) and an external electrode fluorescent lamp (EEFL) in accordance with the position of the electrode(s) of the CCFL lamp. A pair of the electrodes of the IEFL is positioned in a lamp body of the IEFL. A pair of the electrodes of the EEFL is positioned on a lamp body of the EEFL.

Recently, according as a length of an LCD panel measured in a diagonal line increases, the EEFL is used for the LCD. Additionally, the EEFLs are parallel driven and have reduced power consumption.

However, in case of the EEFL, a corona discharge often occurs between the electrodes of the EEFL and the air because the electrodes are disposed on the lamp body, so that harmful gas such as ozone gas is generated around the electrodes due to the corona discharge. Additionally, the corona discharge may cause a fatal damage of the electrodes of the EEFL and most of the parts of the LCD device are corroded by the ozone gas generated around the electrodes of the EEFL, and the ozone gas also may be harmful to a human body.

SUMMARY OF THE INVENTION

Accordingly, the present invention is provided to substantially obviate one or more problems due to limitations and disadvantages of the related art.

It is a first feature of the present invention to provide a lamp assembly capable of preventing a harmful gas such as an ozone gas from generating at the lamp assembly so that electrodes of the lamp assembly may not be damaged.

It is a second feature of the present invention to provide a backlight assembly having the lamp assembly.

It is a third feature of the present invention to provide a display apparatus having the backlight assembly.

It is a fourth feature of the present invention to provide a method of driving lamps used for the display apparatus.

In some exemplary embodiments, a lamp assembly includes a lamp and a lamp driving device. The lamp includes a body and first and second electrodes, the body converts an invisible ray generated by a discharge into a visible ray, and the first and second electrodes are disposed on the body. The lamp driving device is configured to provide the first and second electrodes with first driving voltage and second driving voltage, respectively, to generate the discharge, and the first driving voltage is less than a first critical voltage at which a corona discharge occurs at the first and second electrodes. When the first electrode is electrically connected to a ground, the first critical voltage may be about 1,200 volts. When the second driving voltage has an inverted phase with respect to the first driving voltage, the first critical voltage is about 2,400 volts.

In another exemplary embodiments, a backlight assembly includes a lamp assembly, a lamp driving device and an optical member. The lamp assembly includes a body and first and second electrodes. The body converts an invisible ray generated by a discharge into a visible ray, and the first and second electrodes are disposed on the body. The lamp driving device includes a control part and a lamp driver, the control part controls an output of an AC voltage based on a control signal, and the lamp driver provides the first and second electrodes with first driving voltage and second driving voltage, respectively, to prevent a corona discharge from occurring at the first and second electrodes. The first driving voltage is less than a first critical voltage at which the corona discharge occurs at the first and second electrodes. The optical member is configured to change an optical distribution of light generated from the lamp assembly.

In still another exemplary embodiments, a backlight assembly includes a lamp driving device and a light emitting part. The lamp driving device is configured to convert a first power voltage supplied from an external source into a second power voltage. The light emitting part is configured to generate light in response to the second power voltage, the light emitting part includes a lamp unit, the lamp unit has a plurality of external electrode fluorescent lamps (EEFLs) coupled in parallel to each other, and first ends of the respective external electrode fluorescent lamps are coupled to a ground. The lamp driving device includes a control part configured to output a switching signal based on a control signal, a switching device configured to perform an on/off control for the first power voltage based on the switching signal, and a lamp driver. The lamp driver is configured to convert a third power voltage output from the switching device into an AC voltage, configured to raise a voltage level of the AC voltage to generate the second power voltage, and configured to provide the lamp unit with the second power voltage to prevent an ozone gas from being generated from the lamp unit. The second power voltage is less than a critical voltage at which the ozone gas is generated from the lamp unit.

In still further exemplary embodiments, a backlight assembly includes the lamp driving device and a light emitting part. The light emitting part is configured to generate light in response to the second power voltage, and includes a lamp unit having a plurality of external electrode fluorescent lamps (EEFLS) coupled in parallel to each other. The lamp driving device includes the control part and the switching device. The lamp driver is configured to provide both ends of the lamp unit with the second power voltage to prevent an ozone gas from being generated from the lamp unit. The second power voltage is less than a critical voltage at which the ozone gas is generated from the lamp unit.

In still further exemplary embodiments, a display apparatus includes a backlight assembly and a display assembly. The backlight assembly includes a lamp driving device, a light emitting part and an optical member. The lamp driving device is configured to convert a first power voltage supplied from an external source into a second power voltage. The light emitting part is configured to generate first light in response to the second power voltage. The optical member is configured to change an optical distribution of the first light generated from the light emitting part to generate second light. The display assembly is disposed on the optical member, and is configured to display an image based on the second light. The lamp driving device includes a control part and a lamp driver. The control part is configured to output a switching signal based on a control signal. The lamp driver is configured to convert a third power voltage into an AC voltage, configured to raise a voltage level of the AC voltage to generate the second power voltage, and configured to provide the light emitting part with the second power voltage to prevent an ozone gas from being generated from the light emitting part. The second power voltage is less than a critical voltage at which the ozone gas is generated from the light emitting part.

In still further exemplary embodiments, a method of driving a plurality of lamps used for a display apparatus is performed by providing first external electrodes of the lamps with a first driving voltage to prevent a corona discharge from occurring at the lamps. The first driving voltage is less than a first critical voltage at which the corona discharge occurs at the lamps. Second external electrodes of the lamps are provided with a second driving voltage. A discharge gas contained in the respective lamps is discharged in response to the first and second driving voltages. An invisible ray generated from the discharge are converted into a visible ray using a fluorescent layer formed on inner surface of the respective lamps to provide the invisible ray to the display apparatus.

According to the lamp assembly, a back light assembly having the lamp assembly, a display device having the back light assembly, and a method of driving lamps used for the display apparatus, of this invention, a corona discharge may not be generated at external electrodes to which discharge voltage is applied, so that a harmful gas such as an ozone gas may not be generated at the external electrodes and the damage of the external electrodes may be prevented.

BRIEF DESCRIPTION OF THE DRAWINGS

The above and other features and advantage points of the present invention will become more apparent by describing in detailed exemplary embodiments thereof with reference to the accompanying drawings, in which.

DESCRIPTION OF INVENTION

Hereinafter the preferred embodiment of the present invention will be described in detail with reference to the accompanied drawings.

Lamp Assembly

Figure 1:
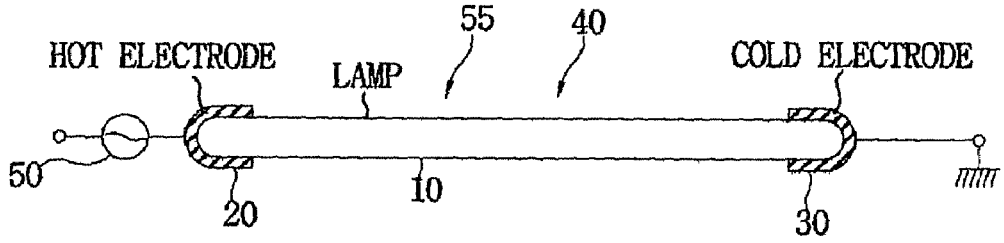
FIG. 1 is a schematic view illustrating a lamp assembly in accordance with one exemplary embodiment of the present invention.
Figure 2:
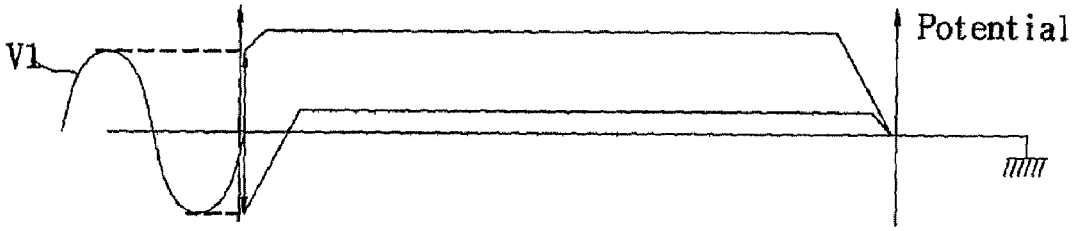
FIG. 2 is a graph showing driving voltages and a potential distribution generated by the driving voltage of the lamp assembly in FIG. 1.

FIG. 1 is a schematic view illustrating a lamp assembly in accordance with one exemplary embodiment of the present invention, and FIG. 2 is a graph showing driving voltages and a potential distribution generated by the driving voltage of the lamp assembly in FIG. 1. Referring to FIG. 1, a lamp assembly 55 includes an external electrode fluorescent lamp (EEFL) 40 and a driving device 50.

The EEFL 40 has a body 10, a first electrode 20, and a second electrode 30.

The body 10 has a transparent tube shape. The body 10 includes a discharge gas (not shown), and a fluorescent layer (not shown). The discharge gas is injected in the body 10, and the discharge gas generates an invisible ray by using a discharge. The fluorescent layer is disposed in the body 10, and the fluorescent layer converts the invisible ray into a visible ray.

The first electrode 20 is positioned on a first end of the body 10.

The second electrode 30 is positioned on a second end of the body 10, and the second end is opposite to the first end of the body 10.

In above embodiment, the second electrode 30 of the EEFL 40 is electrically connected to earth (ground type), and the driving voltage V1 is supplied to the first electrode 20 to cause the discharge between the first electrode 20 and the second electrode 30 via the body 10.

Thus, a corona discharge may occur between the first electrode 20 and air depending upon the level of the driving voltage V1 supplied to the first electrode 20. When the corona discharge occurs at the first electrode 20, an ozone gas is generated around the first electrode 20 so that the first electrode 20 is damaged by the ozone gas.

The driving device 50 supplies an alternating driving voltage V1 to the first electrode 20. In above embodiment, the driving voltage V1 supplied to the first electrode 20 is equal to or lower than a first critical voltage level by which the corona discharge is generated around the first electrode 20. The first critical voltage level is about 1,200 volts. For example, the driving voltage V1 is in a range from about 1,200 volts to about 1,000 volts. A voltage (Herein after refer to a 'tube voltage') applied to glass tubes of the lamp 40 is equal to or lower than a second critical voltage level by which the corona discharge begins to be generated around the first electrode 20. In above embodiment, the level of the second critical voltage is lower than about 1000 volts. For example, the level of the second critical voltage is in a range from about 900 volts to about 1000 volts.

Alternatively, in above embodiment, the plurality of the EEFLs may be arranged in a direction parallel to each other. The first electrodes 20 of each of the EEFLs are electrically in parallel connected to each other, and the second electrodes 30 of each the EEFLs are electrically in parallel connected to each other.

The driving voltage V1 equal to or lower than the critical voltage level is supplied to the first electrode 20 so that the discharge is generated between the first electrode 20 and the second electrode 30 inside the body 10. The invisible ray such as an ultraviolet ray, etc. is generated by the discharge gas in the body 10, the fluorescent layer formed inner surface of the body 10 converts the invisible ray into the visible ray.

The corona discharge and the ozone gas are not generated around the first electrode 20 because the driving voltage V1 supplied to the first electrode 20 is equal to or lower than the critical voltage at which the corona discharge occurs.

Figure 3:
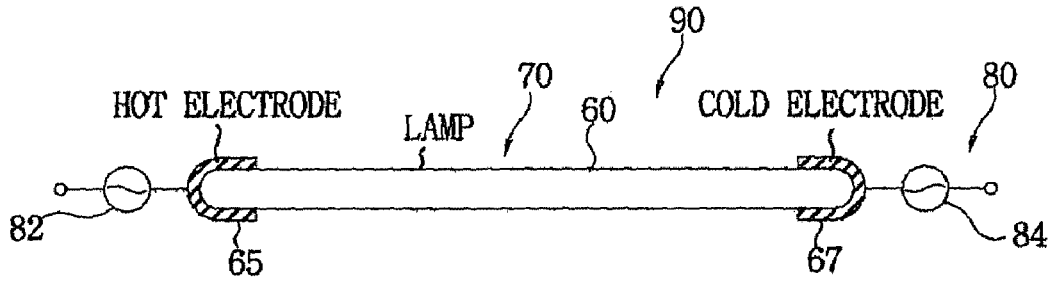
FIG. 3 is a schematic view illustrating a lamp assembly in accordance with another exemplary embodiment of the present invention.
Figure 4:
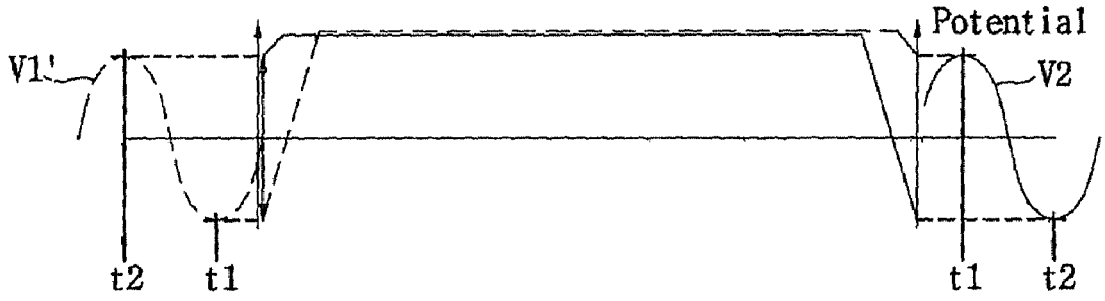
FIG. 4 is a graph showing driving voltages and a potential distribution generated by the driving voltage of the lamp assembly in FIG. 3.

FIG. 3 is a schematic view illustrating a lamp assembly in accordance with another exemplary embodiment of the present invention, and FIG. 4 is a graph showing driving voltages and a potential distribution generated by the driving voltage of the lamp assembly in FIG. 3.

Referring to FIG. 3, a lamp assembly 90 includes an external electrode fluorescent lamp (EEFL) 70 and a driving device 80.

The EEFL 70 has a body 60, a first electrode 65, and a second electrode 67.

The body 60 has a transparent tube shape, and the body 60 includes a discharge gas (not shown), and a fluorescent layer (not shown). The discharge gas is injected into the body 60, and the discharge gas generates an invisible ray by using a discharge. The fluorescent layer is disposed on inner surface of the body 60, and the fluorescent layer converts the invisible ray into a visible ray.

The first electrode 65 is positioned on a first end of the body 60.

The second electrode 67 is positioned on a second end of the body 60, and the second end is opposite to the first end of the body 60.

In above embodiment, a first driving voltage V1' is supplied to the first electrode 65 of the respective EEFL 70 and a second driving voltage V2 is supplied to the second electrode 67 of the respective EEFL 70. The first and second driving voltages V1' and V2 are an alternating voltage, and the first driving voltage has a phase difference with respect to the second driving voltage V2. For example, the second driving voltage V2 has a 180° phase difference with respect to the first driving voltage V1'. Namely, as shown in FIG. 4, the second driving voltage V2 has a maximum value at time 't1' when the first driving voltage V1' has a minimum value at time 't1', and the second driving voltage V2 has a minimum value at time 't2' when the first driving voltage V1' has a maximum value at time 't2'.

Thus, a corona discharge may occur between the first and second electrodes 65 and 67 and the air depending on the level of the first driving voltage V1' and the level of the second driving voltage V2. When the corona discharge occurs between the first and second electrodes 65 and 67, the ozone gas is generated around the first and second electrodes 65 and 67 so that the first and second electrodes 65 and 67 are damaged by the ozone gas.

The driving device 80 supplies the first driving voltage V1' to the first electrode 65, and supplies the second driving voltage V2 to the second electrode 75. In above embodiment, the first driving voltage V1' and the second driving voltage V2 are equal to or lower than the first critical voltage level at which the corona discharge occurs around the first and second electrodes 65 and 67. A tube voltage applied to glass tubes of the lamp 70 is equal to or lower than a second critical voltage level by which the corona discharge begins to be generated around the first and second electrodes 65 and 75. In above embodiment, for example, the level of the second critical voltage is lower than about 2000 volts. The level of the critical voltage may be in a range from about 1800 volts to about 2000 volts.

Alternatively, the plurality of the EEFLs 70 may be arranged in a direction parallel to each other. The first electrodes 65 of the respective EEFLs 70 are electrically in parallel connected to each other, and the second electrodes 67 of the respective EEFLs 70 are electrically in parallel connected to each other.

The first and second driving voltages V1' and V2 respectively equal to or lower than the critical voltage level are supplied to the first and the second electrodes 65 and 67, respectively, so that the discharge is generated between the first and second electrodes 65 and 67 in the body 60. The invisible ray such as ultraviolet ray, etc. is generated by the discharge gas in the body 60, the fluorescent layer formed on inner surface of the body 60 converts the invisible ray into the visible ray.

The corona discharge and the ozone gas are not generated around the first and second electrode 65 and 67 because the first and second driving voltages V1' and V2 supplied respectively to the first and second electrodes 65 and 67 are equal to or lower than the critical voltage level.

When a tube voltage 2,000 volts was applied to glass tubes of a floating type lamp assembly, in which 12 EEFL-fluorescent lamps are arranged in parallel, for 8 hours, the external electrodes of the fluorescent lamp was damaged, and the smell of ozone gas was detected. However, when a tube voltage 1,800 volts was applied to glass tubes of a floating type lamp assembly, in which 12 EEFL-fluorescent lamps are arranged in parallel, for 24 hours, the external electrodes of the fluorescent lamp was not damaged, and the smell of ozone gas was not detected.

When a plurality of EEFLs (or a plurality of EIFLs) is in parallel connected to each other at the ground type lamp assembly, a power voltage less than about 1,200 volts is supplied between both ends of a fluorescent lamp, and a power voltage less than about 1,000 volts is formed between glass tubes of the ground type lamp assembly. Therefore, the density of the ozone gas generated by the corona discharge may be reduced within a predetermined density allowed by international environmental standard and the brightness of the fluorescent lamp may be controlled.

When a plurality of EEFLs (or a plurality of EIFLs) is in parallel connected to each other at the floating type lamp assembly, a power voltage less than about 2,400 volts is supplied between both ends of a fluorescent lamp, and a power voltage less than about 2,000 volts is formed between glass tubes of the floating type lamp assembly. Therefore, the density of the ozone gas generated by the corona discharge may be reduced within a predetermined density allowed by international environmental standard and the brightness of the fluorescent lamp may be controlled.

Although above exemplary embodiments discuss a plurality of EEFLs is in parallel connected to each other at the lamp assembly, a plurality of EIFLs could be utilized at the lamp assembly, or EEFLs and EIFLs together could be utilized at the lamp assembly. In addition, when the EIFLs are in parallel connected to each other at the lamp assembly, the external electrodes may be connected to each other and the internal electrodes may be connected to each other.

Back Light Assembly

Figure 5:
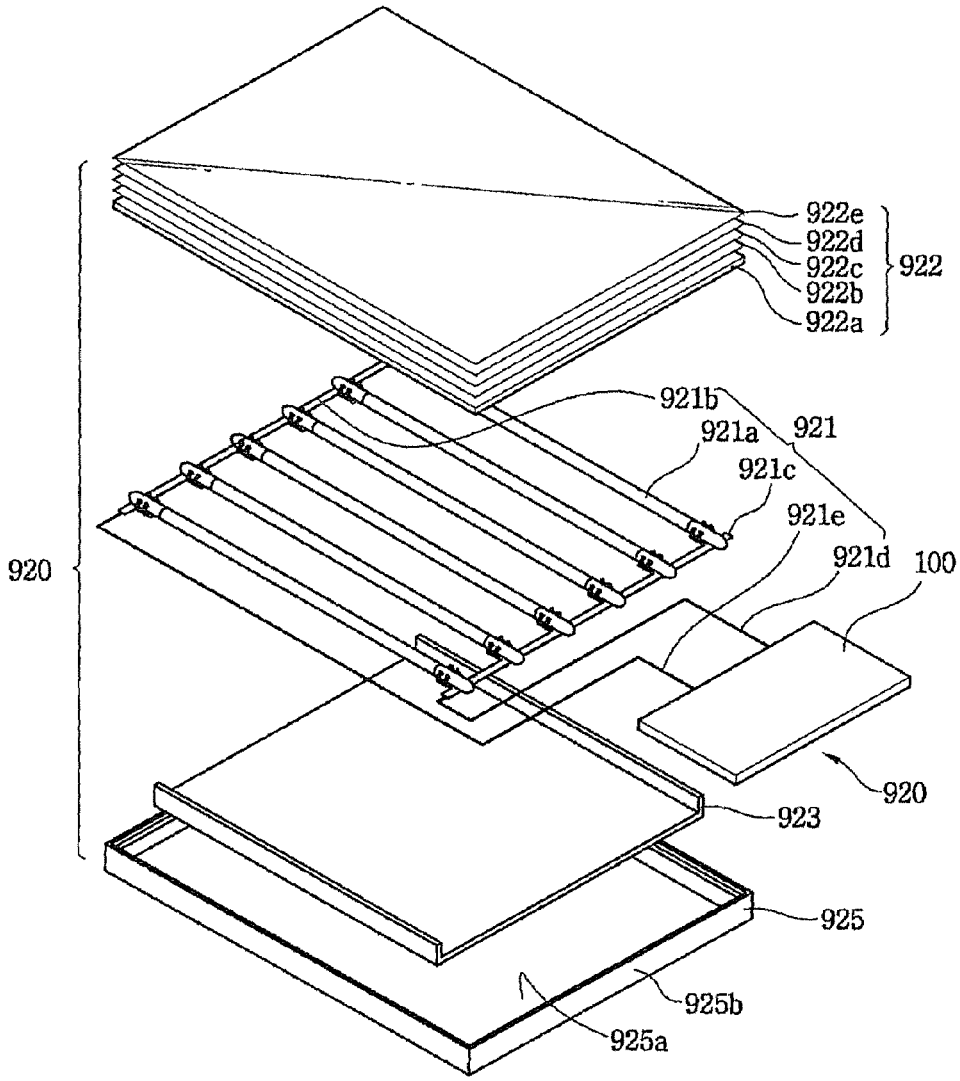
FIG. 5 is an exploded perspective view illustrating a backlight assembly according to one exemplary embodiment of the present invention.

FIG. 5 is an exploded perspective view illustrating a backlight assembly according to one exemplary embodiment of the present invention.

Referring to FIG. 5, the backlight assembly 920 includes a receiving container 925, a lamp assembly 921, a light reflector 923, an optical member 922 and a bottom chassis 925.

The optical member 922 includes a diffusion plate 922*a* for diffusing the light, a diffusion sheet 922*b* that is disposed on the diffusion plate 922*a*, first and second prism sheets 922*b* and 922*c* that is disposed on the diffusion sheet 922*b* and a protect sheet 922*e* that is disposed on the second prism sheet 922*c*. Alternately, the optical member 922 may have one prism sheet.

The receiving container 925 has a bottom face 925*a* and sidewalls 925*b*. For example, the bottom face 925*a* has a rectangular plate shape. The sidewall 925*b* and the bottom face 925*a* form a receiving space.

The lamp assembly 921 is received on the bottom face 925*a*. The lamp assembly 920 is disposed on the light reflector 923*a*. The lamp assembly 920 includes a lamp body 921*a*, first and second lamp clip modules 921*b* and 921*c*, and first and second power supplying wires 921*d* and 921*e* and a lamp driving device 100.

The lamp assembly 921 includes a pair of external electrodes formed on a body 921*a* of the lamp 921. The first and second lamp clip modules 921*b* and 921*c* are connected to the external electrodes of the lamp 921 so as to provide a driving power voltage to the lamp 921*a*. The first and second power supplying wires 921*d* and 921*e* connects each of the first and second lamp clip modules 921*b* and 921*c* to the lamp driving device 100.

The bottom chassis 925 has a bottom face 925*a* and a plurality of sidewalls 925*b*. The bottom face 925*a* has a rectangular plate shape and the sidewalls 925*b* is extended from an edge portion of the bottom face 925*a* so as to provide a receiving space.

The light reflector 923 is disposed on the bottom face 925*a* of the bottom chassis 925. For example, the light reflector 923 includes material having high light reflectivity such as metal.

The backlight assembly 920 may include a mold frame (not shown). The mold frame is disposed on the external electrodes so as to cover the external electrodes of the lamp 921*a*.

Figure 6:
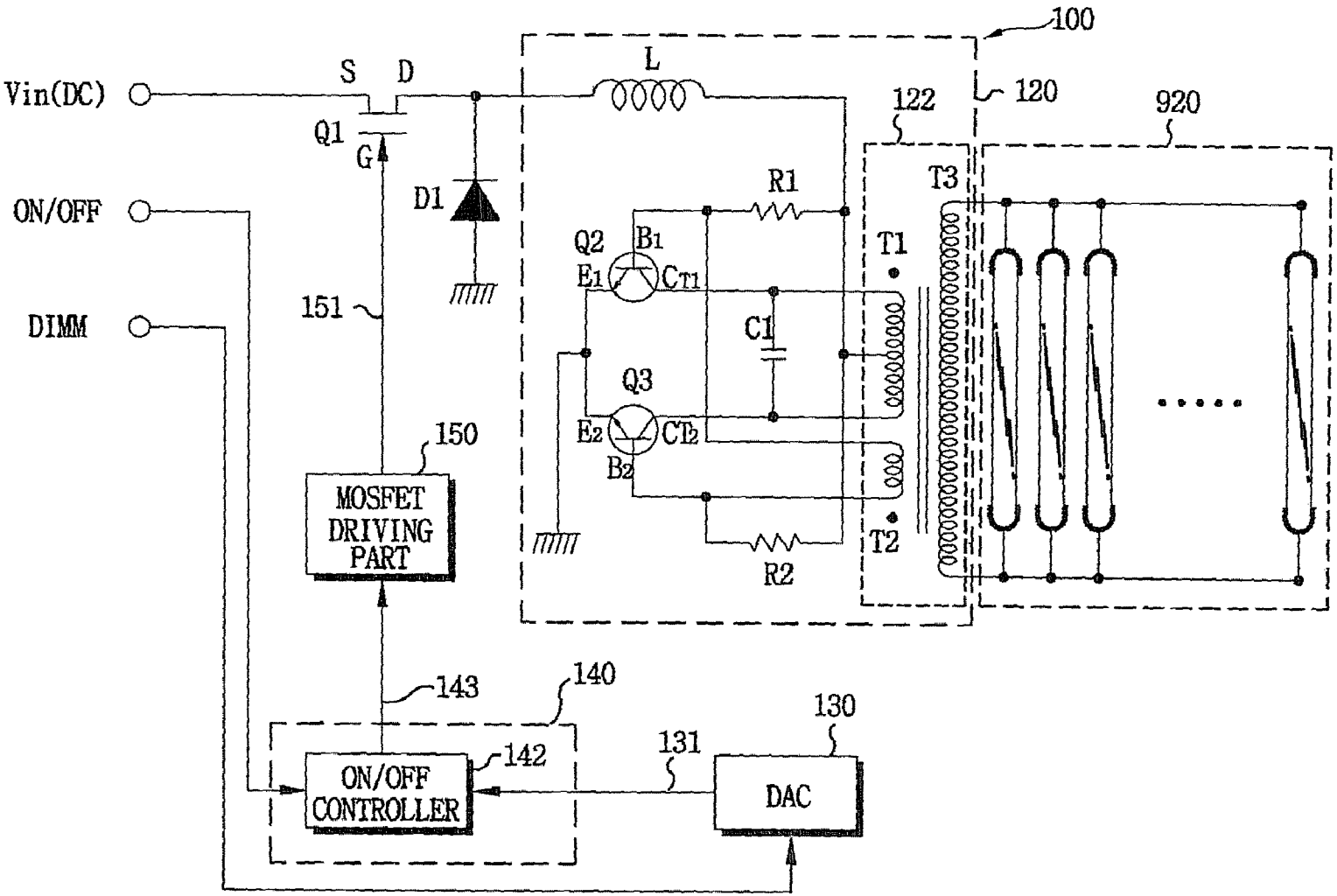
FIG. 6 is a circuit diagram illustrating the lamp driving device of a backlight assembly according to one exemplary embodiment of the present invention.

FIG. 6 is a circuit diagram illustrating the lamp driving device of a backlight assembly according to one exemplary embodiment of the present invention.

Referring to FIGS. 5 and 6, the lamp driving device 100 includes a power transistor Q1, a diode D1, a lamp driver 120, a digital-to-analogue converter (DAC) 130, a pulse width modulation (PWM) control part 140 and a power transistor driving part 150. The lamp driving device 100 converts an external DC power signal into an AC power signal having a low voltage level of less than about 2000 volts, and supplies the AC power signal to the lamp assembly 920. The lamp driving device 100 may be used not only in an external electrode fluorescent lamp (EEFL), in which the first and second electrodes 921*b* and 921*c* are formed at both ends of the lamp body 921*a*, but also in the EIFL (External Inner electrode Fluorescent Lamp), in which the first electrode 921*a* or the second electrode 921*b* is formed in the lamp body 921*a*. Although not shown in FIG. 6, a ballast capacitor may be inserted at one end of the lamp assembly 920 or at both ends of the lamp assembly 920.

The power transistor Q1 is turned on in response to a switching signal 151 input to a gate electrode G thereof, the power transistor Q1 has a source electrode S for receiving an DC power signal, and a drain electrode D for outputting a pulse power signal to the lamp driver 120. The pulse power signal is a pulse signal that swings between a zero voltage level and the voltage level of the DC power signal.

A cathode of the diode D1 is connected to the drain electrode D of the power transistor Q1, and an anode of the diode D1 is connected to a ground, so that the diode D1 prevents a rush current generated from the lamp driver 120 from flowing into the power transistor Q1.

The lamp driver 120 includes an inductor L, a transformer 122, a resonant capacitor C1, first and second resistors R1 and R2 and first and second transistors Q2 and Q3. A first end of the lamp driver 120 is connected to the drain electrode D of the power transistor Q1. The lamp driver 120 converts the pulse power signal outputted from the power transistor Q1 into an AC power signal so that the AC power signal has an increase voltage level compared with that of the pulse power signal, and provides each of the lamp assemblies 920 with the AC power signal. For example, the lamp driver 120 may be a resonance type royer inverter.

More particularly, a first end of the inductor L is connected to the drain electrode D of the power transistor Q1 and the inductor L removes impulse due to the pulse power signal, and inductor L outputs the impulse-removed power signal through the second end of the inductor L. The inductor L accumulates electromagnetic energy, returns and averages a counter electromotive force back to the diode D1 during a turn-off period of the power transistor Q1, i.e. serves as a kind of switching regulator.

The transformer 122 includes first and second coils T1 and T2 and a third coil T3. The first and second coils T1 and T2 correspond to a primary coil, and the third coil T3 corresponds to a secondary coil. The AC power signal that is applied to the first coil T1 via the inductor L is transmitted to the third coil T3 by an electromagnetic induction, and is converted into a raised voltage AC signal having a low voltage level of less than about 2400 volts. The raised voltage AC signal is applied to the lamp assembly 920. The first coil T1 receives the AC power signal from the inductor L via a center tap. A turn ratio between the third coil T3 and the first coil are adjusted so as to output the raised voltage AC signal having a low voltage level of less than about 2400 volts via the third coil T3. When the raised voltage AC signal outputted from the third coil T3 is supplied to the lamp assembly 910, a voltage supplied to the lamp assembly 910 is lower less than about 2,000 volts due to a voltage drop of the raised AC power signal by the wire, which connects a transformer 122 to the lamp 920, and by the plasma gas injected into the lamp body 921*a* of the lamp assembly 910. Thus, a voltage difference between the raised AC power signal and the voltage supplied to tube glasses of the fluorescent lamp exists due to a voltage drops by the wire and the plasma gas. When the voltage difference is reduced, the voltage level of the raised AC power signal may be decreased, however when the voltage difference is increased, the voltage level of the raised AC power signal may be increased.

The second coil T2 turns on selectively one of the first and second transistors Q2 and Q3 in response to the AC power signal applied to the first coil T1.

The resonant capacitor C1 is connected in parallel to both ends of the first coil T1 to make an LC resonance circuit together with an inductance of the first coil T1.

A base of the first transistor Q2 is connected to the inductor L through the first resistor R1 and receives the AC power signal through the resistor R1. A collector CT1 of the first transistor Q2 is connected to a first end of the resonant capacitor C1 and a first end of the first coil T1 to drive the transformer 122. A base of the second transistor Q3 is connected to the inductor L through the second resistor R2. A collector CT2 of the second transistor Q3 is connected to a second end of the resonant capacitor C1 and a second end of the first coil T1 to drive the transformer 122. An emitter E2 of the second transistor Q3 is connected to the emitter of the first transistor Q2 and is commonly connected to the ground.

The DAC 130 converts an external dimming signal (DIMM) into an analog signal, and outputs the converted analog dimming signal to the PWM control part 140. The dimming signal is inputted by a user so as to control the brightness of the lamp, and has a constant duty ratio as a digital value.

The PWM control part 140 includes an on/off controller. The PWM control part is turned on or off by an external on/off control signal, and provides the power transistor driving part 150 with a switching signal 143, which controls the voltage level of the AC power signal provided to each of the lamps, in response to the converted analog dimming signal. The PWM control part 140 may further include an oscillator (not shown) so as to provide an oscillating signal to the on/off controller 142 that does not have oscillation function.

The power transistor driver 150 amplifies the signal 143 for controlling the voltage level of the AC power signal provided from the PWM control part 140, and provides the power transistor Q1 with the amplified signal 151. In other words, the signal outputted from the PWM control part 140 has a low voltage level that is not enough to turn on the power transistor Q1, so that the power transistor driver 150 amplifies the low voltage level signal.

Hereinafter, the power supplying part is described in detail. The power supplying part, i.e. the lamp driver 120, converts an AC signal having a low voltage level into an AC signal having a high voltage level.

The pulse power signal that is generated by the power transistor Q1 is applied to the base of a first transistor Q2 via the first resistor R1. Both ends of the first coil T1 are connected in parallel to collectors of each of the first and second transistors Q2 and Q3 of which emitter is connected to the ground, and the capacitor C1 is connected in parallel to collectors of each of the first and second transistors Q2 and Q3.

The pulse power signal is applied to a center tap of the first coil T1 of the transformer 122 via the inductor L. The inductor L includes a choke coil that converts the current provided to the lamp driver 120 into a constant current.

The third coil T3 has more winding number than the first coil T1 so as to raise the voltage level. The lamps in the lamp array are connected in parallel to the third coil T3 of the transformer 122 to provide each of the fluorescent lamps with raised AC power voltage. The AC voltage has a positive peak value and a negative peak value, and the negative peak value may have the same magnitude as the positive peak value. Alternatively, an interval between the negative peak and the positive peak may be constant.

A first end of the second coil T2 of the transformer 122 is connected to the base of the first transistor Q2. A second end of the second coil T2 is connected to the base of the second transistor Q3. The second coil T2 provides the bases of each of the first and second transistors Q2 and Q3 with a voltage applied to the second coil T2.

Hereinafter, the operation of the lamp driver 120 is described in detail.

First, when the pulse power signal is applied to the lamp driver 120, a current flows into the first coil T1 of the transformer 122 via the inductor L, and simultaneously the pulse power signal is applied to the base of the first transistor Q2 through the first resistor R1 and the pulse power signal is applied to the base of the second transistor Q3 through the second resistor R2. A resonance circuit is formed by the reactance of the first coil T1 and the resonant capacitor C1.

Accordingly, at the secondary coil, i.e. between both ends of the third coil T3, a raised voltage is generated by the turn ratio, which represents (T3's winding number)/(T1's winding number). At the same time, at the primary coil of the transformer 122, i.e. at the second coil T2, a current of the second coil T2 flows in a reverse direction to the current direction at the first coil T1.

Then, a voltage level is raised at the third coil T3 by the turn ratio, or (T3's winding number)/(T1's winding number), and a high voltage signal having a frequency and phase synchronized with the voltage signal of the primary coil. Accordingly, the flickering phenomenon may be prevented.

Figure 7:
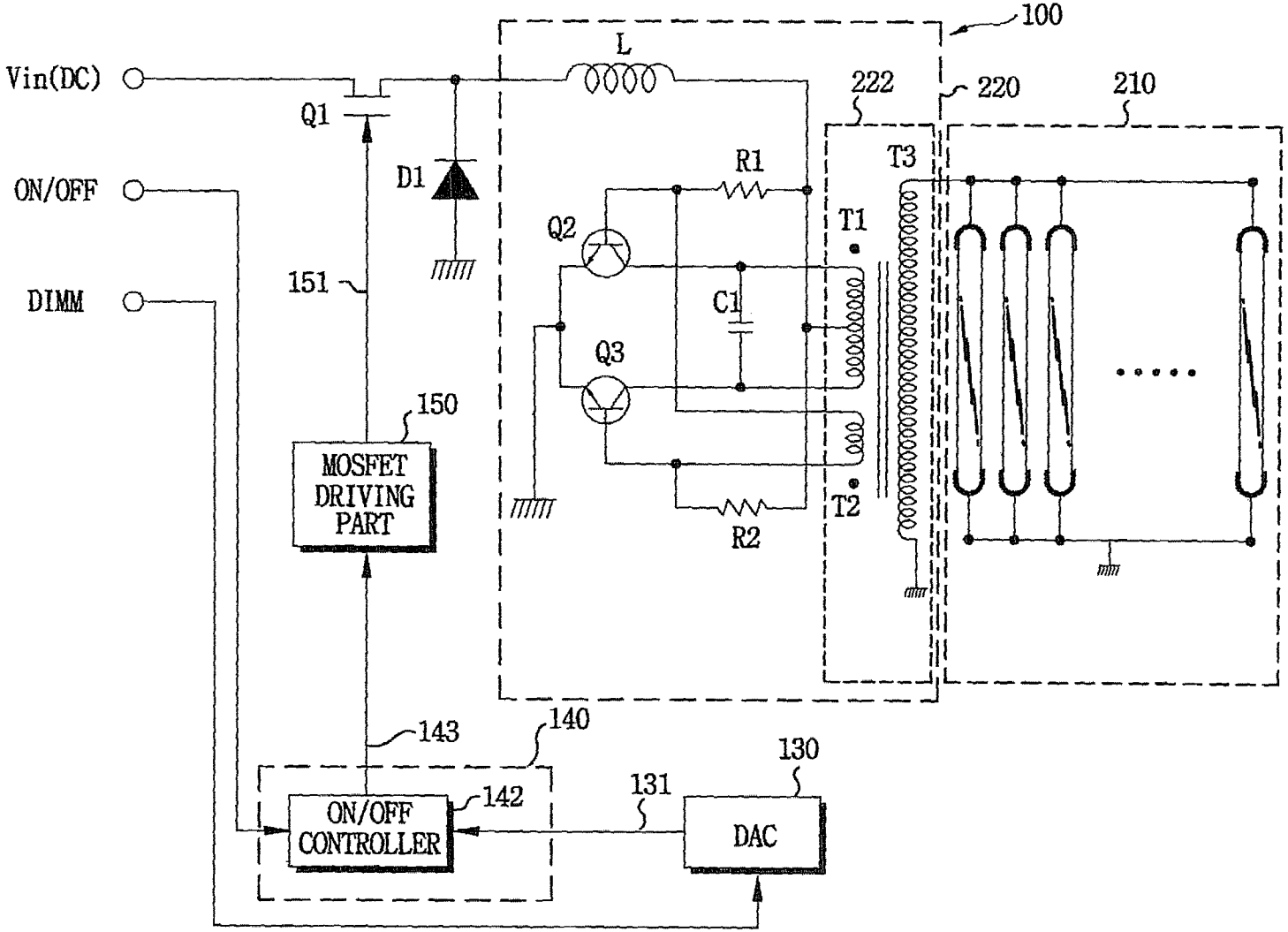
FIG. 7 s a circuit diagram illustrating a lamp driving device of a backlight assembly according to another exemplary embodiment of the present invention.

FIG. 7 s a circuit diagram illustrating a lamp driving device of a backlight assembly according to another exemplary embodiment of the present invention, especially shows a ground type lamp driving device without feedback function.

Referring to FIG. 7, the lamp driving device includes a power transistor Q1, a diode D1, a lamp driver 220, a digital-to-analogue converter DAC 130, a PWM control part 140 and a power transistor driving part 150.

The lamp driving device converts external DC power signal into AC power signal, and supplies the AC power signal to the lamp array 210, i.e. external electrode fluorescent lamps connected in parallel. Hereinafter, like reference numerals identify similar or identical elements, and detailed descriptions about the identical elements will be omitted.

Compared with FIG. 4, the differences are as followings. A first end of the third coil T3, which is a secondary coil of the transformer 222 in the lamp driver 220, is connected to the ground. Also, each of the first electrodes 921*b* is commonly connected with each other and receives a raised AC power signal from the lamp driver 220, and all the second electrodes 921*c* is commonly connected to the ground. The raised AC power signal has a voltage level less than a critical voltage level at which the corona discharge begins to occur.

When the raised AC power signal has a voltage level lower than about 1,200 volts due to a voltage drop of the raised AC power signal by the wire, which connects a transformer 222 to the lamp assembly 210, and by the plasma gas injected into the lamp body of the lamp assembly 210. Thus, a voltage difference, i.e. 200 volts, between the raised AC power signal and the tube voltage supplied to the glass tubes of the lamp assembly 910 exists due to a voltage drop at the wire and a voltage drop at the plasma gas. When the voltage drops at the wire and the plasma gas is reduced, the raised AC power signal may have a voltage level less than 1,200 volts, however, when the voltage drops at the wire and the plasma gas is increased, the raised AC power signal may have a voltage level higher than 1,200 volts.

<Display Devices>

Figure 8:
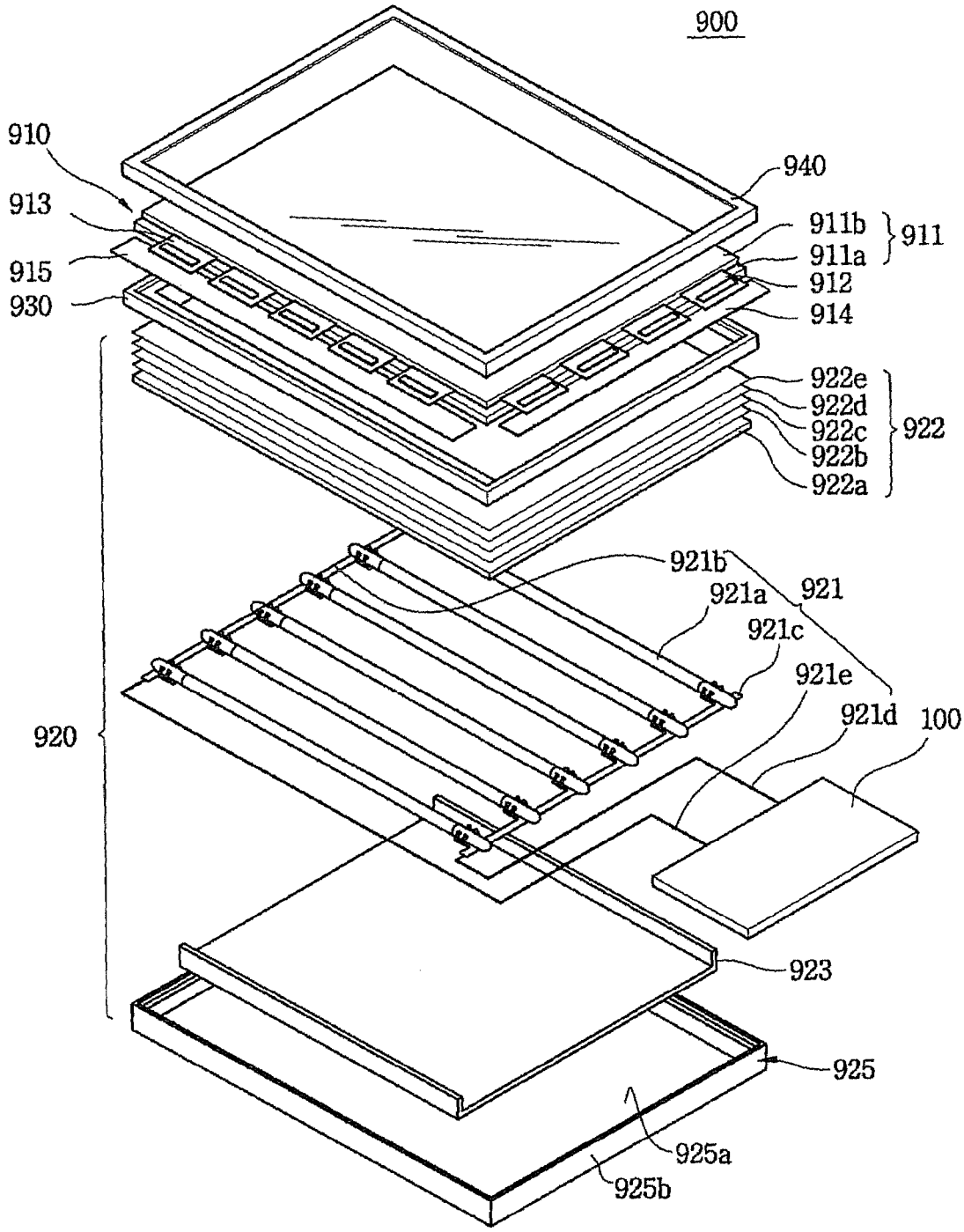
FIG. 8 is an exploded perspective view illustrating a display device in accordance with another exemplary embodiment of the present invention.

FIG. 8 is an exploded perspective view illustrating a display device in accordance with another exemplary embodiment of the present invention.

Referring to FIG. 8, a liquid crystal display device 900 includes a display panel assembly 910 for displaying an image and a backlight assembly 920 for providing a light to the display panel assembly 910.

The display panel assembly 910 includes a thin film transistor (TFT) substrate 911*a*, a color filter substrate 911*b* and a liquid crystal layer (not shown) interposed between the thin film transistor substrate 911*a* and the color filter substrate 911*b*. The thin film transistor substrate 911*a* of the display panel assembly 910 includes a first printed circuit board 915, a second printed circuit board 914, a first tape carrier package 913 and a second tape carrier package 912.

The backlight assembly 920 includes a receiving container 925, a lamp assembly 921, a reflector 923, an optical member 922 and a bottom chassis 925.

The receiving container 925 has a bottom face 925*a* and sidewalls 925*b*. For example, the bottom face 925*a* has a rectangular plate shape. The sidewall 925*b* and the bottom face 925*a* form a receiving space.

The lamp assembly 921 is received on the bottom face 925*a*. The lamp assembly 921 includes a lamp 921*a*, first and second lamp clip modules 921*b* and 921*c*, and first and second power supplying wires 921*d* and 921*e* and a lamp driving device 100.

The lamp assembly 921 includes a pair of external electrodes formed on a body of the lamp 921. The first and second lamp clip modules 921*b* and 921*c* are connected to the external electrodes of the lamp 921 so as to provide a driving power voltage to the lamp 921*a*. The first and second power supplying wires 921*d* and 921*e* connects each of the first and second lamp clip modules 921*b* and 921*c* to the lamp driving device 100.

The lamp driving device 100 supplies the driving power voltage to the external electrodes of the lamp 921 via the first and second power supplying wires 921*d* and 921*e*, and the first and second lamp clip modules 921*b* and 921*c*.

The reflector 923 is interposed between the bottom face 925*a* and the lamp assembly 921. The reflector 923 reflects a light generated from the lamp 921*a* toward the display panel assembly 910.

The backlight assembly 920 may include a mold frame (not shown). The mold frame is disposed on the external electrodes so as to cover the external electrodes of the lamp 921*a*.

The optical member 922 is disposed on the lamp assembly 921. The optical member 922 includes a diffusion plate 922*a* for diffusing the light, a diffusion sheet 922*b* that is disposed on the diffusion plate 922*a*, first and second prism sheets 922*b* and 922*c* that is disposed on the diffusion sheet 922*b* and a protect sheet 922*e* that is disposed on the second prism sheet 922*c*. Alternately, the optical member 922 may have one prism sheet.

In order to assembly the display panel assembly 910 with the receiving container 925, a middle chassis 930 is disposed on the sidewall 925*b*, and the display panel assembly 910 is disposed on the middle chassis 930. A top chassis 940 combines with the receiving container 925 so as to fix the display panel assembly 910 to the receiving container 925.

When a plurality of EEFLs (or a plurality of EIFLs) is in parallel connected to each other at the floating type lamp assembly, a power voltage is supplied between both ends of a fluorescent lamp so that a power voltage (a tube voltage) less than about 2,000 volts may be applied to glass tubes of the floating type lamp assembly. Therefore, the density of the ozone gas generated by the corona discharge may be reduced within a predetermined density allowed by international environmental standard, and the brightness of the fluorescent lamp may be controlled.

When a plurality of EEFLs (or a plurality of EIFLs) is in parallel connected to each other at the ground type lamp assembly, a power voltage is supplied between both ends of a fluorescent lamp so that a power voltage (tube voltage) less than about 1,000 volts is applied to the glass tubes of the ground type lamp assembly. Therefore, the density of the ozone gas generated by the corona discharge may be reduced and the brightness of the fluorescent lamp may be controlled.

Having described the exemplary embodiments of the present invention and its advantages, it is noted that various changes, substitutions and alterations can be made herein without departing from the spirit and scope of the invention as defined by appended claims.

What is claimed is:

1. A backlight assembly comprising:

a plurality of lamps, each of the lamps including a body converting an invisible ray generated by a discharge into a visible ray and first and second electrodes, at least one of the first and second electrodes being external electrode disposed on the body;

a lamp driving device including a lamp driver respectively providing the first and second electrodes with first and second driving voltages, the lamp driver including a transformer having primary and secondary coils, a turn ratio between the primary and secondary coils being adjusted so that the first driving voltage is less than a critical voltage; and an optical member changing an optical distribution of light incident from the lamp, wherein the lamps are electrically connected to the secondary coil of the transformer in parallel.

2. The backlight assembly of claim 1, wherein a corona discharge occurs at the first and second electrodes at the critical voltage, and the lamp driver prevents the corona discharge from occurring at the first and second electrodes.

3. The backlight assembly of claim 2, wherein the critical voltage is the same or less than 1,200 volts.

4. The backlight assembly of claim 3, wherein the critical voltage is the same or less than 1,000 volts.

5. The backlight assembly of claim 2, wherein the first electrode is electrically connected to a ground.

6. The backlight assembly of claim 2, wherein the second driving voltage has an inverted phase with respect to the first driving voltage.

7. A liquid crystal display (LCD) apparatus comprising:

a backlight assembly including:

a plurality of lamps, each of the lamps including a body converting an invisible ray generated by a discharge into a visible ray and first and second electrodes, at least one of the first and second electrodes being external electrode disposed on the body;

a lamp driving device including a lamp driver respectively providing the first and second electrodes with first and second driving voltages, the lamp driver including a transformer having primary and secondary coils, a turn ratio between the primary and secondary coils being adjusted so that the first driving voltage is less than a critical voltage; and an optical member changing an optical distribution of light incident from the lamp; and a display panel receiving the light from the optical member to display an images, wherein the lamps are electrically connected to the secondary coil of the transformer in parallel.

8. The LCD apparatus of claim 7, wherein a corona discharge occurs at the first and second electrodes at the critical voltage, and the lamp driver prevents the corona discharge from occurring at the first and second electrodes.

9. The LCD apparatus of claim 8, wherein the critical voltage is the same or less than 1,200 volts.

10. The LCD apparatus of claim 9, wherein the critical voltage is the same or less than 1,000 volts.

11. The LCD apparatus of claim 8, wherein the first electrode is electrically connected to a ground.

12. The LCD apparatus of claim 8, wherein the second driving voltage has an inverted phase with respect to the first driving voltage.

* * * * *